US007013820B2

(12) United States Patent
Sakamoto et al.

(10) Patent No.: US 7,013,820 B2
(45) Date of Patent: Mar. 21, 2006

(54) SHIP AND OPERATING METHOD THEREFOR

(75) Inventors: Toshinobu Sakamoto, Nagasaki (JP); Satoru Ishikawa, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 93 days.

(21) Appl. No.: 10/321,575

(22) Filed: Dec. 18, 2002

(65) Prior Publication Data

US 2003/0140836 A1 Jul. 31, 2003

(30) Foreign Application Priority Data

Jan. 22, 2002 (JP) ..... P 2002-013034

(51) Int. Cl.
*B63H 25/00* (2006.01)

(52) U.S. Cl. ..... 114/144 R; 440/53

(58) Field of Classification Search ..... 114/144 R, 114/146, 164; 440/51, 79, 53, 80

See application file for complete search history.

(56) References Cited

U.S. PATENT DOCUMENTS

| | | | | |
|---|---|---|---|---|
| 3,596,625 | A * | 8/1971 | Guenther | 440/6 |
| 3,996,877 | A | 12/1976 | Schneekluth | |
| 6,165,031 | A | 12/2000 | Lönngren et al. | |

FOREIGN PATENT DOCUMENTS

| | | | |
|---|---|---|---|
| DE | 946776 | | 8/1956 |
| DE | 3207398 | A1 * | 9/1983 |
| DE | 19654511 | A1 | 7/1998 |
| JP | 55145096 | A * | 11/1980 |
| JP | 58211994 | A * | 12/1983 |
| JP | 6-56082 | | 3/1994 |
| WO | 89/05262 | | 6/1989 |

* cited by examiner

*Primary Examiner*—Jesus D. Sotelo
(74) *Attorney, Agent, or Firm*—Wenderoth, Lind & Ponack, L.L.P.

(57) ABSTRACT

A ship has a main propeller 2 which can move the ship forward and reverse by normal rotation, reverse rotation or by changing the pitch angle. A drive unit drives the main propeller 2. A rudder 3 changes the course of the ship. At least one pod propulsion unit 10A, 10B is provided. As a result, the support mechanism and the turning mechanism of the pod propulsion unit, arranged separate from the main propeller, can be simplified and cost can be reduced.

23 Claims, 7 Drawing Sheets

SHIP AND OPERATING METHOD THEREFOR

BACKGROUND OF THE INVENTION

1. Field of the Invention

The present invention relates to a ship incorporating a pod propulsion unit in addition to a main propeller, and an operating method therefor.

2. Background Art

Recently, in propulsion devices for ships, in the case where the thrust generated by the main propeller is insufficient, it has been suggested, in order to increase the thrust, to provide a pod propulsion unit to the rear or the front of the main propeller at a position which does not interfere.

FIG. 9 shows related technology explained in Japanese Patent Application No. 2001-199418, which was filed by the assignee of the present application on Jun. 29, 2001 and has not been published yet. In the technology shown in FIG. 9, reference symbol 1 denotes the stern of the hull of a ship, 2 denotes a main propeller for generating the main propulsive force for propelling the ship, while 10 denotes a pod propulsion unit. The main propeller 2 is rotated by a driving force from a drive mechanism (omitted from the figure) such as a diesel engine (generally referred to as the main engine).

The pod propulsion unit 10 is furnished with a casing 11, a pod propeller 12, a strut 13, and a support 14.

With regards to the casing 11, the pod propeller 12 is provided at an approximately circular cylindrical rear portion or front portion, or at both the front and rear portions (not shown in the figure). The pod propeller 12 has the function of generating a propulsion force by rotation thereof. An electric motor for driving the pod propeller 12 is provided inside the casing 11.

The strut 13, of air foil section, is provided on the upper portion of the casing 11. The support 14, which constitutes the overall turning axis for the pod propulsion unit 10, is provided on the upper end of the strut 13. The support 14 is connected to a drive mechanism (not shown in the figure) provided on the hull side. Hence the pod propulsion unit 10 is provided so that the whole unit can be turned with respect to the stern 1 of the ship via the support 14.

The ship constructed in this way obtains a propulsive force by rotating the main propeller 2, rotating the pod propeller 12, or rotating both the main propeller 2 and the pod propeller 12 together. Furthermore, by turning the pod propulsion unit 10 about the support 14, the strut 13 demonstrates a steering function to give a steering force, and thus turn the ship.

In the above described ship, high speed cruising, faster than for a ship equipped with only the main propeller 2, is possible. Furthermore, the strut 13 of the pod propulsion unit 10 can be used as a rudder. Consequently, when steering, particularly at the time of high speed cruising (for example, cruising in excess of around 20 knots), an excessive hydrodynamic force acts on the strut 13, so that a very large force is applied to the support 14. Therefore, there is a problem in that the support mechanism for supporting the support 14 and the turning mechanism for turning the pod propulsion unit 10 must have sufficient strength, that is, these must involve large mechanisms.

The present invention takes into consideration the abovementioned circumstances, with the object of providing a ship and an operating method therefor so that the support mechanism and the turning mechanism and the like of the pod propulsion unit, arranged at the rear of the main propeller, can be simplified and cost can be reduced.

SUMMARY OF THE INVENTION

In order to solve the abovementioned problem, a ship of the present invention comprises a main propeller which can move the ship forward and in reverse by normal rotation, reverse rotation or by changing the pitch angle; a drive unit which drives the main propeller; a rudder which changes the course of the ship; and at least one pod propulsion unit.

According to the ship of the present invention, the propulsive force is obtained from the main propeller and/or the pod propulsion unit, and steering is by means of the rudder, and/or the rudder due to the pod propulsion unit. Therefore, the ship speed can be increased, and the ship handling performance can be improved.

The ship may further comprises a speed log which measures the speed of the ship and a control unit which controls a rudder angle of the pod propulsion unit based on a signal from the speed log.

In this case, the rudder angle of the pod propulsion unit is controlled corresponding to a signal from a speed log for measuring the speed of the hull, that is, corresponding to the ship speed. Therefore a situation where an excessive load is applied to the support mechanism and the turning mechanism of the pod propulsion unit can be prevented. Hence these mechanisms can be simplified and the cost reduced.

In the above ship, when a ship speed obtained by the speed log exceeds a predetermined value, the control unit may fix the rudder angle of the pod propulsion unit to zero degrees.

In this case, if the ship speed exceeds a predetermined value, the rudder angle of the pod propulsion unit is fixed at zero. Therefore a situation where an excessive load is applied to the support mechanism and the turning mechanism of the pod propulsion unit can be prevented. Hence these mechanisms can be simplified and cost reduced.

When a ship speed obtained by the speed log is less than a predetermined value, the control unit may set the rudder angle of the pod propulsion unit linked to a rudder angle of the rudder.

In this case, the rudder angle of the pod propulsion unit is made to correspond to the rudder angle of the rudder. Therefore the ship operator simply orders (controls) only the rudder angle of the rudder. Hence, the rudder angle of the rudder and of the pod propulsion unit can be controlled simultaneously, and ship handling thus greatly simplified.

The ship may further comprise a rudder angle switching device which switches the rudder angle of the pod propulsion unit to either one of +90° and −90°.

In this case, the construction is such that by setting a switching device to a position of 0°, +90°, −90° the rudder angle of the pod propulsion unit is set to a position of 0°, +90°, −90°. Therefore construction of the overall equipment can be simplified. That is, the steering gear for the pod propulsion unit can be omitted, and hence cost is further reduced.

The ship may further comprise a drive source which drives both a steering gear for changing the rudder angle of the rudder and a turning drive mechanism which changes the rudder angle of the pod propulsion unit.

In this case, a steering gear which changes the rudder angle of the rudder and a turning drive mechanism which changes the rudder angle of the pod propulsion unit are driven by the same drive source. Therefore the construction of a drive source for driving the steering gear and the turning drive mechanism can be simplified, and hence cost can be further reduced.

The second aspect of the present invention is a method for operating a ship comprising a main propeller which can move the ship forward and in reverse by normal rotation, reverse rotation or by changing the pitch angle; a drive unit which drives the main propeller; a rudder which changes the course of the ship; at least one pod propulsion unit; a speed log which measures the speed of the ship; and a control unit which controls a rudder angle of the pod propulsion unit by means of a signal from the speed log. The operating method comprises the steps of, when the ship speed obtained by the speed log exceeds a predetermined value, changing the course direction of the ship by changing only the rudder angle of the rudder; and when the ship speed is less than a predetermined value, changing the course direction and/or the travelling direction of the ship using the rudder and the pod propulsion unit together, or using only the pod propulsion unit.

According to the operating method for a ship, in changing the course direction and/or the travelling direction of the ship, when the ship speed exceeds a predetermined value, only the rudder is used, while when the ship speed is less than a predetermined value, the rudder and the pod propulsion unit are used together. Therefore, when the ship speeds exceeds a predetermined value, a situation where an excessive load is applied to the support mechanism and the turning mechanism of the pod propulsion unit can be prevented. Moreover, when the ship speed is less than a predetermined speed the ship handling performance can be improved.

In the above method, a rudder angle of the pod propulsion unit may be controlled based on a signal from the speed log.

In this case, the rudder angle of the pod propulsion unit is controlled corresponding to a signal from a speed log for measuring the speed of the hull, that is, corresponding to the ship speed. Therefore a situation where an excessive load is applied to the support mechanism and the turning mechanism of the pod propulsion unit can be prevented. Hence these mechanisms can be simplified and cost reduced.

When a ship speed value obtained by the speed log exceeds a predetermined value, the rudder angle of the pod propulsion unit may be fixed at 0° by the control unit.

In this case, if the ship speed exceeds a predetermined value, the rudder angle of the pod propulsion unit is fixed at 0°. Therefore a situation where an excessive load is applied to the support mechanism and the turning mechanism of the pod propulsion unit in cruising at a ship speed which exceeds the predetermined value can be prevented.

DETAILED DESCRIPTION OF THE INVENTION

Hereunder is a description of embodiments of a ship according to the present invention, with reference to the drawings. Parts similar to those of the above mentioned technology are denoted by the same reference symbols, and detailed description thereof is omitted.

Figure 1A:
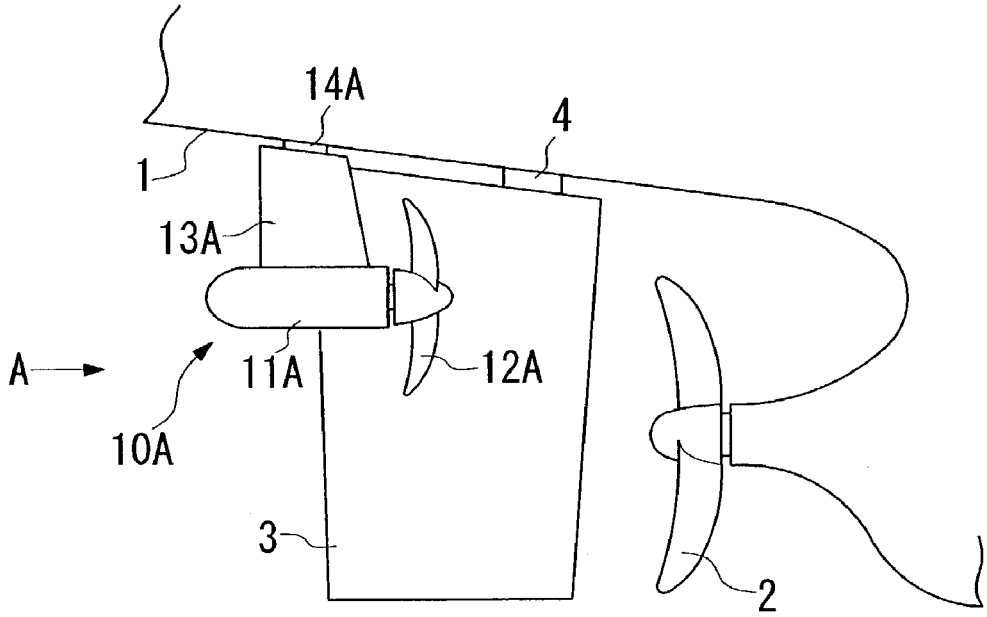
FIG. 1A and FIG. 1B show an embodiment of a ship according to the present invention, FIG. 1A being a schematic starboard side view of the stern of the ship, and FIG. 1B being a view as seen in the direction of arrow A of FIG. 1A.
Figure 1B:
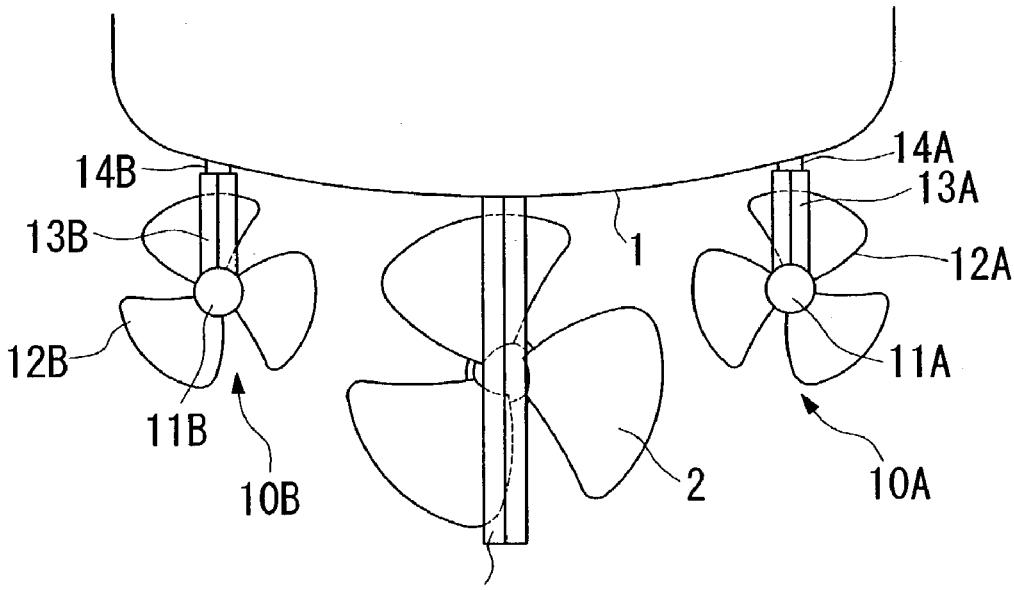

As is shown in FIGS. 1A and 1B, this ship has a main propeller 2, a rudder 3 located to the rear of the main propeller 2 and turnably attached to the stern 1 of the ship via support 4, and two pod propulsion units 10A and 10B located on either side of the rudder 3. The pod propulsion units 10A and 10B respectively have casings 11A and 11B, pod propellers 12A and 12B, struts 13A and 13B, and supports 14A and 14B.

The rudder 3 is a planar member having a streamline cross-section. Furthermore, the support 4 is attached vertically to the top of the rudder 3, and the upper end side of the support 4 is connected to a steering gear (omitted from the figure) provided on the hull side to turn the rudder 3 and the support 4 as one.

The pod propulsion units 10A and 10B are each turnably attached to the stern 1 via the supports 14A and 14B. Regarding the pod propulsion units 10A and 10B, the pod propellers 12A and 12B for producing a thrust are provided on the rear or on the front (on the front in the example in the figure). Moreover the pod propulsion units 10A and 10B are furnished with casings 11A and 11B housing a propeller drive mechanism (omitted from the figure) such as an electric motor thereinside, and struts 13A and 13B of airfoil section which are secured integrally to the upper portions of the casings 11A and 11B. The supports 14A and 14B are attached vertically to the top of the struts 13A and 13B, and the upper end side of the supports 14A and 14B are connected to steering drive mechanisms (omitted from the figure) provided on the hull side to turn the supports 14A and 14B, the struts 13A and 13B, the casings 11A and 11B, and the pod propellers 12A and 12B as one.

In the pod propulsion units 10A and 10B constructed in this manner, a thrust is produced by rotating the pod propellers 12A and 12B to propel the ship. Moreover, by turning the whole of the thruster with respect to the stern 1, a steering function is obtained, enabling the travelling direction of the ship to be changed.

The pod propulsion units 10A and 10B are a type, as shown in the figure, with electric motors for outputting a drive force for the pod propellers 12A and 12B installed inside the casings 11A and 11B, or a type which receives a drive force from a drive source (omitted from the figure) such as an electric motor installed on the hull side.

In a ship of such a construction, a propulsive force can be obtained by rotating the main propeller 2 by itself, or by rotating one or both of the pod propellers 12A and 12B, or by rotating the main propeller 2 and one or both of the pod propellers 12A and 12B together.

Furthermore, in order to change the course direction and/or the travelling direction of the ship, the rudder 3 is turned about the support 4, or one or both of the pod propulsion units 10A and 10B are turned about the supports 14A and 14B, or the rudder 3 and one or both of the pod propulsion units 10A and 10B are turned.

In the case where the change in the course direction and/or the travelling direction of the ship is mainly performed by the rudder 3, the portions for the struts 13A and 13B of the pod propulsion units 10A and 10B can be made smaller than for the conventional case.

As a result, the load applied to the support mechanism and the steering mechanism of the pod propulsion units 10A and 10B can be reduced, thus enabling simplification of these mechanisms.

Consequently, when high speed cruising is required (for example at more than 20 knots), the thrust can be obtained by rotating the main propeller 2 and both of the pod propulsion units 12A and 12B together.

Furthermore, when medium speed cruising is required (for example at around 12 knots) such as at the time of cruising in a channel, the thrust can be obtained by rotating the main propeller 2 by itself, or by rotating only the two pod propellers 12A and 12B.

Moreover, when low speed cruising is required (for example at less than 5 knots) such as when entering and leaving port, the thrust can be obtained by rotating only the two pod propulsion units 12A and 12B.

Figure 2:
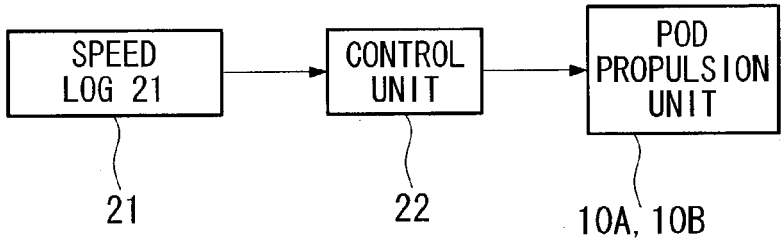
FIG. 2 is a block diagram showing a configuration for controlling the rudder angle of a pod propulsion unit provided in the ship according to the present invention.

In the present embodiment, in addition to the above construction there may be provided, as shown in FIG. 2, a speed log 21 for measuring ship speed, and a control unit 22 which can control the rudder angle of the pod propulsion units 10A and 10B by means of a signal from the speed log 21.

Figure 3:
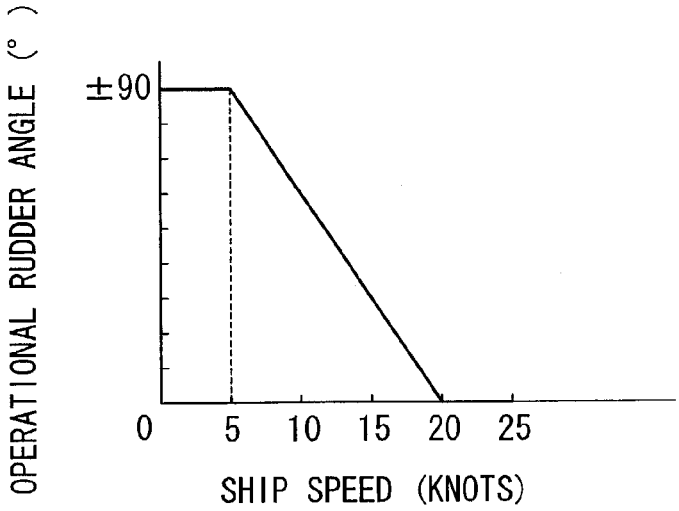
FIG. 3 is a graph showing a relationship between operational rudder angle and ship speed illustrating an example of where a control apparatus for a ship according to the present invention controls the rudder angle of a pod propulsion unit.
Figure 4:
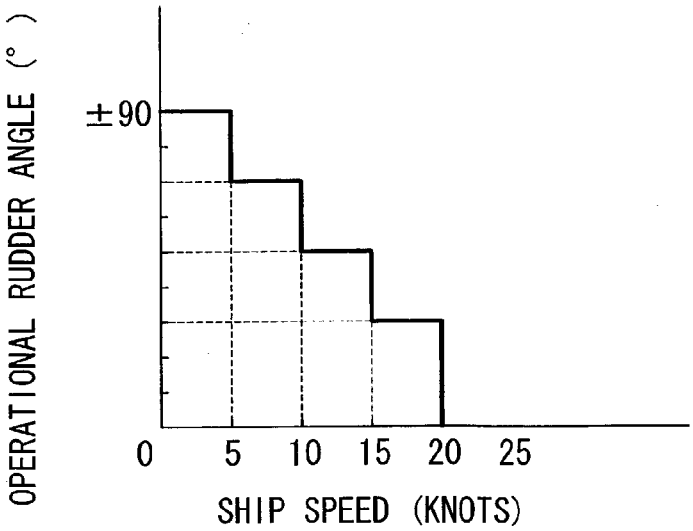
FIG. 4 is a graph showing a relationship between operational rudder angle and ship speed illustrating another example of where the control apparatus for a ship according to the present invention controls the rudder angle of a pod propulsion unit.

By using these devices, then, for example, rudder angle control for the pod propulsion units 10A and 10B, as shown for example in FIG. 3 and FIG. 4, can be performed.

The control shown in FIG. 3 illustrates a control where, when the ship speed is less than 5 knots, the rudder angle of the pod propulsion units 10A and 10B can be kept within a range of ±90° (here 0° degrees indicates the bow direction), while when the ship speed exceeds 20 knots, the rudder angle is fixed at zero and steering is not possible.

That is to say, the information on ship speed obtained by the speed log 21 shown in FIG. 2 is sent as a signal to the control unit 22, and the control unit 22, based on this signal, controls the maximum rudder angle which the pod propulsion units 10A and 10B can take.

Furthermore, the control shown in FIG. 4, controls such that, when the ship speed is less than 5 knots, the rudder angle of the pod propulsion units 10A and 10B can be kept within a range of ±90° (here 0° degrees indicates the bow direction). When the ship speed is more than 5 knots and less than 10 knots, the rudder angle of the pod propulsion units 10A and 10B can be kept within a range of ±70°. When the ship speed is greater than 10 knots and less than 15 knots, the rudder angle of the pod propulsion units 10A and 10B can be kept within a range of ±50°. When the ship speed is greater than 15 knots and less than 20 knots, this is kept within a range ±30°, and when the ship speed exceeds 20 knots, the rudder angle is fixed at zero and steering is not possible.

As shown in FIG. 3 and FIG. 4, when the ship speed exceeds 20 knots for example, the rudder angle of the pod propulsion units 10A and 10B is fixed at zero, and the course is changed by the rudder 3 only. Hence an excessive hydrodynamic force does not act on the struts 13A and 13B, and a situation where an excessive load is applied to the supports 14A and 14B can thus be prevented. Consequently, the strength of the support mechanism for supporting the supports 14A and 14B and the strength of the turning mechanism for turning the pod propulsion units 10A and 10B can be reduced, enabling these mechanisms to be simplified and cost thus reduced.

A ship as described above furnished with the main propeller 2, the rudder 3 located to the rear thereof and turnably attached to the stern 1 via the support 4, the two pod propulsion units 10A and 10B located on either side of the rudder 3, the speed log 21 for measuring ship speed, and the control unit 22 which can control the rudder angle of the pod propulsion units 10A and 10B by a signal from the speed log 21, can be operated for example as described hereunder.

For example, when the ship is cruising at a high speed which exceeds a ship speed of 20 knots, the thrust can be obtained by rotating both the main propeller 2 and the two pod propellers 12A and 12B together, while the rudder angle of the pod propulsion units 10A and 10B is fixed at zero, and course change is performed by the rudder 3 only.

Next, when cruising at more than 5 knots and less than 20 knots, the thrust is obtained by rotating the main propeller 2 alone, or by rotating only the two pod propellers 12A and 12B, and course change is performed by using the rudder 3 together with the pod propulsion units 10A and 10B which are controlled so that the maximum rudder angle depends on the ship speed.

Moreover, when low speed cruising is required (for example at less than 5 knots) such as when entering and leaving port, thrust is obtained by rotating only the two pod propulsion units 12A and 12B, and course change and/or a change in travelling direction is performed by using the pod propulsion units 10A and 10B together with the rudder 3.

In particular, since the rudder angle of the pod propulsion units 10A and 10B at less than 5 knots can be ±90°, the pod propulsion units 10A and 10B can function as stern thrusters. Therefore, pier or shore docking can be made easy, and operating time required for entering and leaving port can be reduced.

In the embodiment of the present invention, the description has been for where the operational rudder angle of the pod propulsion units 10A and 10B is ±90° (refer to FIG. 3 and FIG. 4). However the present invention is not limited to this, and this may be ±360°.

In particular, if when the ship speed is less than 5 knots, the operational rudder angle of the pod propulsion units 10A and 10B can be ±360°, then thrust in the rearward direction (stern power) which is variously used at the time of pier or shore docking can be obtained by the pod propulsion units 10A and 10B. Therefore there is no need to start a drive unit (in general the main engine) for rotating the main propeller 2 in order to obtain stern power.

Furthermore the construction may be such that the rudder angle of the pod propulsion units 10A and 10B is linked to the rudder angle of the rudder 3 and the ship speed.

That is to say, when for example the ship speed exceeds 20 knots, the rudder angle of the pod propulsion units 10A and 10B is fixed at zero degrees by the control unit 22. When the ship speed is greater than 5 knots and less than 20 knots the rudder angle of the pod propulsion units 10A and 10B is made proportional to the rudder angle of the rudder 3. For example, at +35° rudder angle for the rudder 3, the pod propulsion units 10A and 10B have +14° rudder angle, and at +10° rudder angle for the rudder 3, the pod propulsion units 10A and 10B have +4° rudder angle. Moreover, when the ship speed is less than 5 knots, then at +35° rudder angle for the rudder 3, the pod propulsion units 10A and 10B have +90° rudder angle, and at +10° rudder angle for the rudder 3, the pod propulsion units 10A and 10B have +45° rudder angle.

By having such a construction, the ship operator can control the rudder angle of the rudder 3 and of the pod propulsion units 10A and 10B simultaneously by ordering only the rudder angle of the rudder 3, thus greatly simplifying ship handling.

Furthermore, an arrangement is possible such that the pod propulsion units 10A and 10B can only be used at a position where their rudder angle is for example +90° and −90°.

That is to say, at the time of normal cruising, the rudder angle of the pod propulsion unit may be fixed at zero degrees, and steering performed by the rudder only, while at the time of pier or shore docking, the rudder angle of the pod propulsion units 10A and 10B may be positioned at for example +90 degrees or −90 degrees, so as to function as stern thrusters. Therefore pier or shore docking can be made easy, and operating time required for entering and leaving port can be reduced. Changing of this rudder angle position is performed by a separately provided switching device.

By having such a construction, the steering gear for the pod propulsion unit can be omitted, and hence cost is further reduced.

The construction may also be such that hydraulic pressure produced by the steering gear for the rudder 3 is also used in the turning drive mechanism which changes the rudder angle of the pod propulsion units 10A and 10B.

That is to say, the hydraulic pressure produced by a hydraulic pump (drive source) provided in the steering gear of the rudder 3 is used in the turning drive mechanism which changes the rudder angle of the pod propulsion units 10 and 10B. As a result, the hydraulic pump can be omitted from the turning drive mechanism, enabling simplification of the construction for the turning drive mechanism, and hence cost can be reduced.

Figure 5:
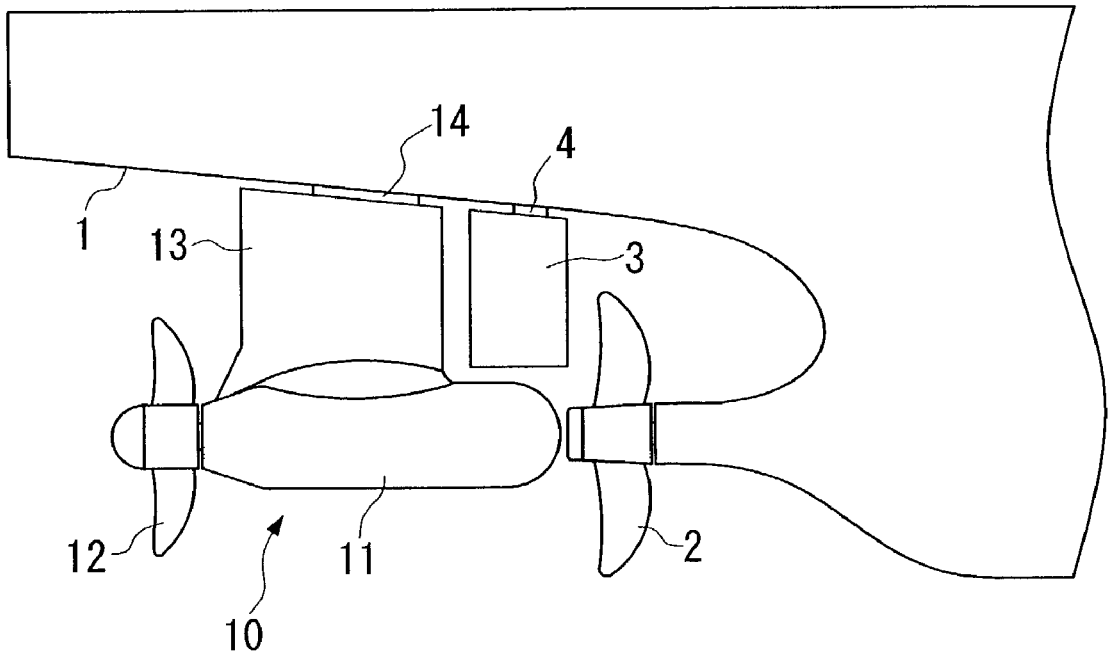
FIG. 5 is a schematic starboard side view showing a different embodiment of a ship according to the present invention.

In the embodiment as described above, the description has been for where two pod propulsion units are provided. However the present invented is not limited to this, and as shown in FIG. 5, a single pod propulsion unit 10 incorporating a pod propeller 12 on the rear end of a casing 11 may be provided so that the main propeller 2, the rudder 3 and the pod propulsion unit 10 are in sequence from the bow in a straight line along the keel line.

Figure 6:
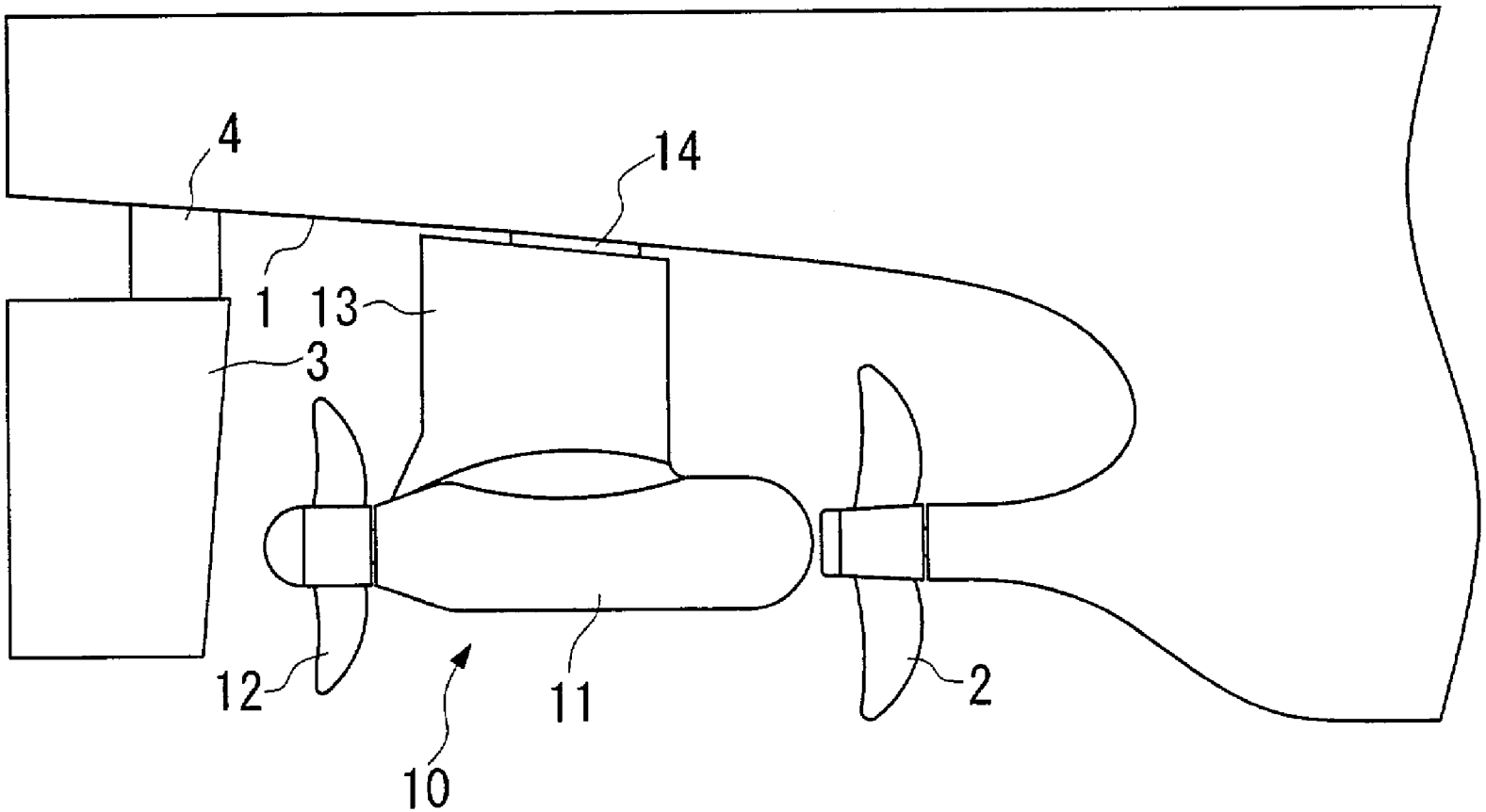
FIG. 6 is a schematic starboard side view showing another embodiment of a ship according to the present invention.

Furthermore, as shown in FIG. 6, a single pod propulsion unit 10 incorporating a pod propeller 12 on the rear end of a casing 11 may be provided so that the main propeller 2, the pod propulsion unit 10 and the rudder 3 are in sequence from the bow in a straight line along the keel line.

Figure 7:
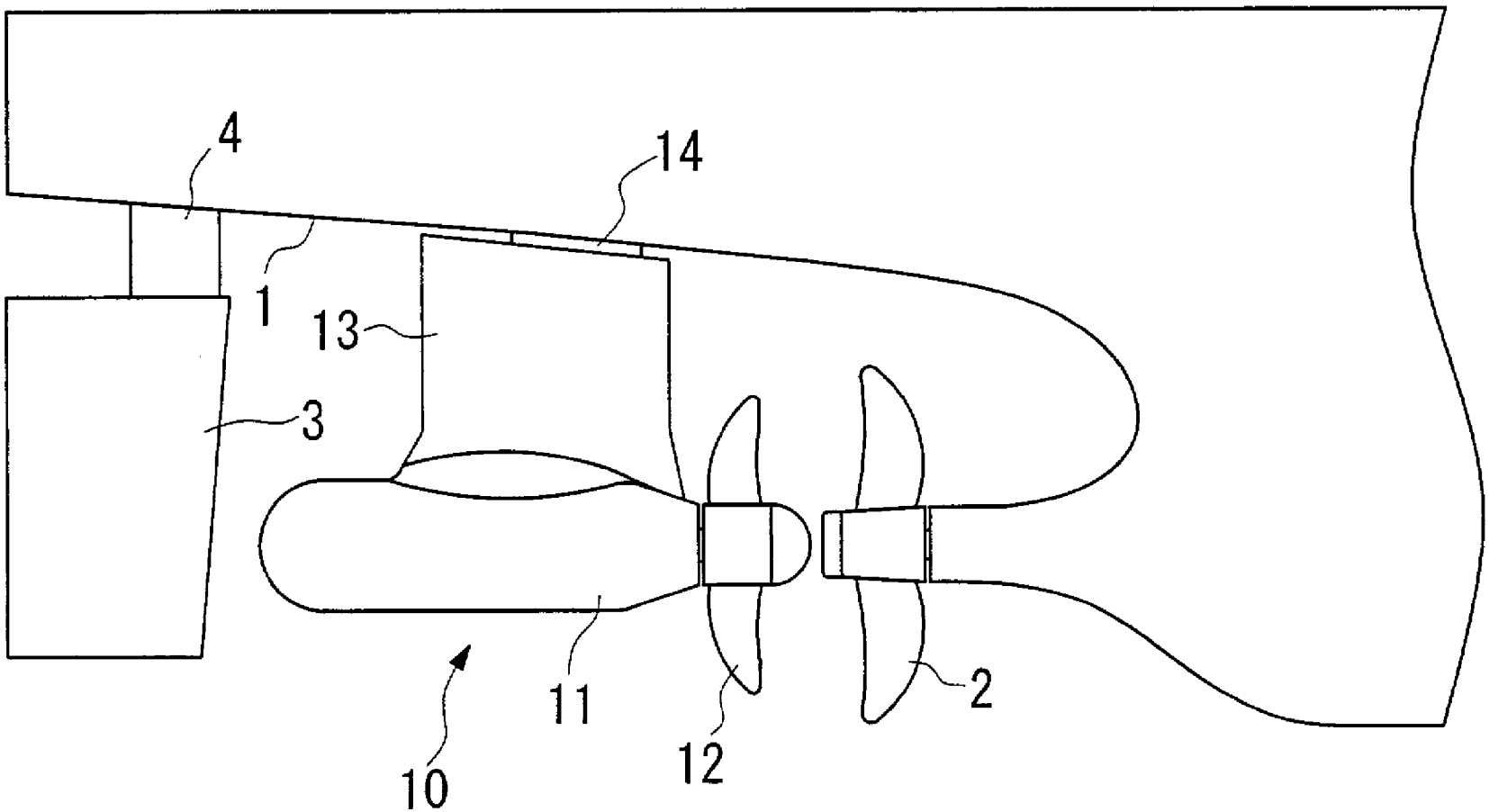
FIG. 7 is a schematic starboard side view showing yet another embodiment of a ship according to the present invention.
Figure 8:
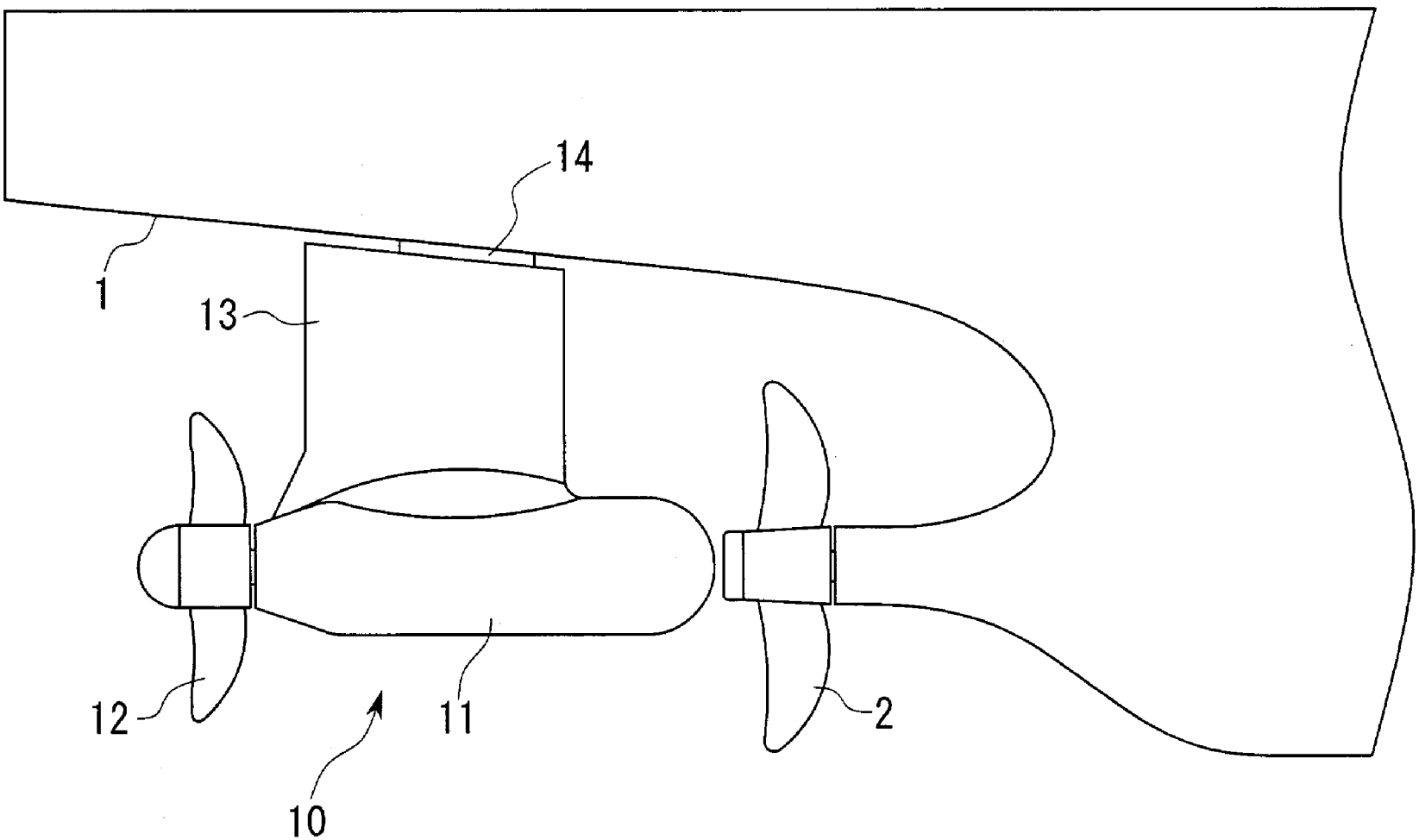
FIG. 8 is a schematic starboard side view of the stern of a ship showing an example of a ship where a pod propulsion unit is provided in addition to a main propeller.
Figure 9:
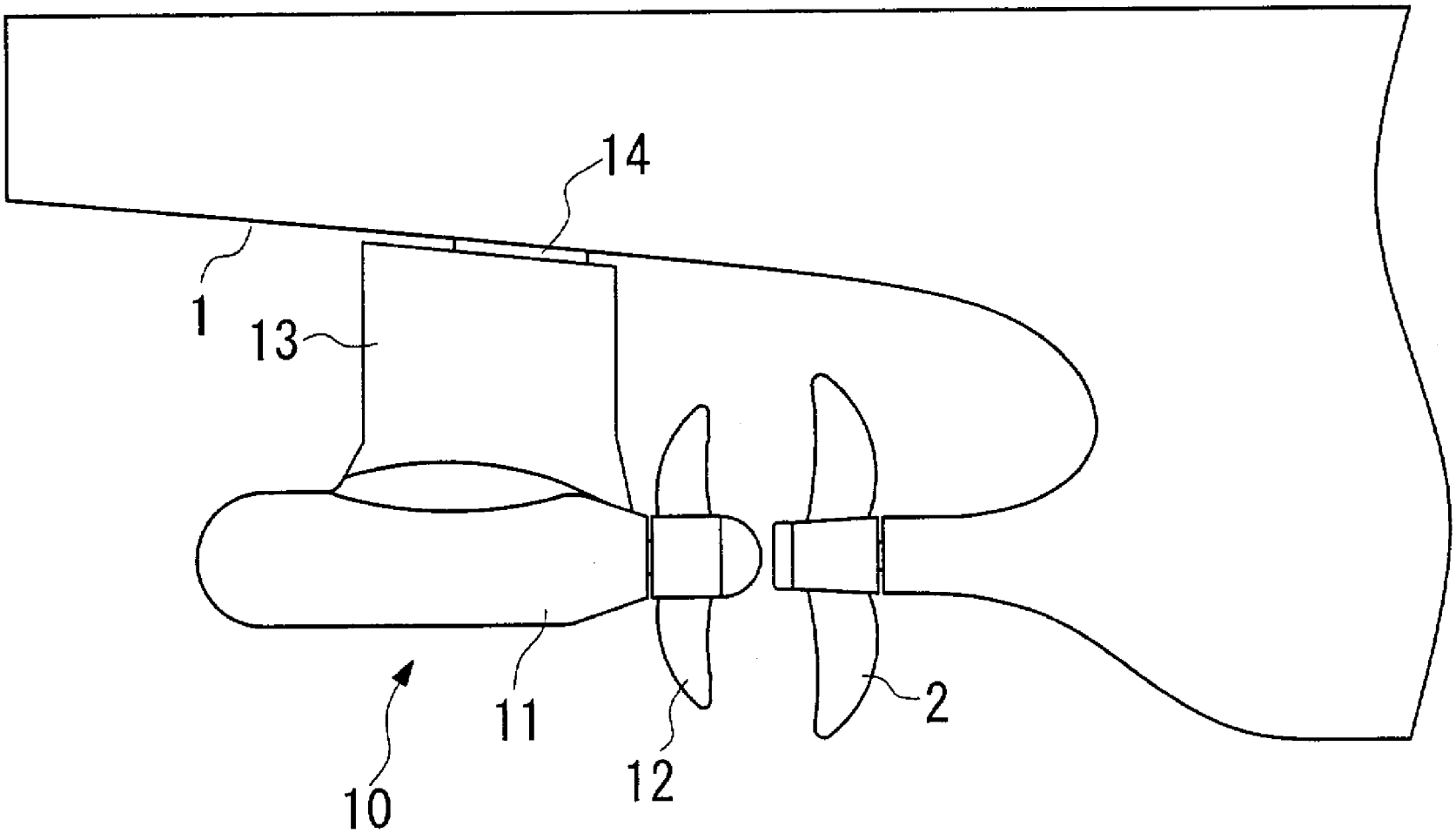
FIG. 9 is a schematic starboard side view of the stern of a ship showing another example of a ship where a pod propulsion unit is provided in addition to a main propeller.

Moreover, as shown in FIG. 7, a single pod propulsion unit 10 incorporating a pod propeller 12 on the front end of the casing 11 may be provided so that the main propeller 2, the pod propulsion unit 10 and the rudder 3 are in sequence from the bow in a straight line along the keel line.

What is claimed is:

1. A ship comprising:

a main propeller which can move the ship forward and reverse by normal rotation, reverse rotation or by changing the pitch angle, said main propeller having no steering function;

a drive unit which drives said main propeller;

at least one pod propulsion unit incorporating a strut having a steering function; and a rudder which changes the course of said ship, and said rudder being movable to steer the ship independently of said main propeller and said pod propulsion unit.

2. A ship according to claim 1 further comprising:

a speed log which measures the speed of said ship, and a control unit which controls a steering angle of said pod propulsion unit based on a signal from said speed log.

3. A ship according to claim 2, wherein when a ship speed obtained by said speed log exceeds a predetermined value, said control unit fixes said rudder angle of said pod propulsion unit to zero degrees with respect to a centerline of said ship.

4. A ship according to claim 2, wherein when a ship speed obtained by said speed log is less than a predetermined value, said control unit sets said steering angle of said pod propulsion unit in linkage with a rudder angle of said rudder.

5. A ship according to claim 1 further comprising a steering angle switching device which switches said rudder angle of said pod propulsion unit to either one of +90° and −90° with respect to a centerline of said ship.

6. A ship according to claim 1 further comprising a drive source which drives both a steering gear for changing a rudder angle of said rudder, and a turning drive mechanism which changes a steering angle of said pod propulsion unit.

7. A ship according to claim 1 further comprising:

a speed log which measures the speed of said ship, and a control unit which controls a range of the rudder angle of the pod propulsion unit so as to decrease as said ship speed obtained from said speed log increases.

8. A ship according to claim 7 wherein when said ship speed obtained by said speed log exceeds a predetermined value, said control unit fixes said rudder angle of said pod propulsion unit to zero degrees.

9. A method of operating a ship, wherein said ship comprises:

a main propeller which can move the ship forward and reverse by normal rotation, reverse rotation or by changing the pitch angle;

a drive unit which drives said main propeller;

a rudder which changes the course of said ship;

at least one pod propulsion unit incorporating a strut having a steering function;

a speed log which measures the speed of said ship; and a control unit which controls a steering angle of said pod propulsion unit by means of a signal from said speed log, said method of operating a ship comprising:

when the ship speed obtained by said speed log exceeds a predetermined value, changing the course direction of said ship by changing only the rudder angle of said rudder; and when said ship speed is less than a predetermined value, changing at least one of the course direction and the travelling direction of said ship by using said rudder and said pod propulsion unit together, or by using only said pod propulsion unit.

10. A method of operating a ship according to claim 9, wherein a steering angle of said pod propulsion unit is controlled based on a signal from said speed log.

11. A method of controlling a ship according to claim 10, wherein when a ship speed value obtained by said speed log exceeds the predetermined value, the steering angle of said pod propulsion unit is fixed at 0° by said control unit.

12. A ship comprising:

a ship hull;

a main propeller positioned at the stern of said ship hull, said main propeller having no steering function;

a drive unit inside said hull to drive said main propeller;

at least one pod propulsion unit incorporating a steering strut having an airfoil section to provide a steering function; and a rudder positioned at the stern of said ship hull and aft of said main propeller, said rudder being movable to steer the ship independently of said main propeller and said pod propulsion unit.

13. The ship of claim 12, and further comprising:

a speed log to measure speed of said ship; and a control unit operable to control a steering angle of said pod propulsion unit based on a signal from said speed log.

14. The ship of claim 13, wherein said control unit is further operable to, when the speed of said ship measured by said speed log exceeds a predetermined value, fix said steering angle of said pod propulsion unit at zero degrees with respect to a centerline of said ship hull.

15. The ship of claim 13, wherein said control unit is further operable to, when the speed of said ship measured by said speed log is less than a predetermined value, set said rudder angle of said pod propulsion unit in coordination with a steering angle of said rudder.

16. The ship of claim 12, and further comprising a rudder angle switching device operable to switch a steering angle of said at least one pod propulsion unit with respect to a centerline of said ship hull between zero degrees, +90 degrees and −90 degrees.

17. The ship of claim 12, and further comprising a steering gear for changing a rudder angle of said rudder, a turning drive mechanism for changing a steering angle of said pod propulsion unit and a drive source to drive both said steering gear and said turning drive mechanism.

18. The ship of claim 12, and further comprising:

a speed log to measure speed of said ship hull; and a control unit operable to control a range of rudder angle of said pod propulsion unit to decrease as speed of said ship hull measured by said speed log increases.

19. The ship of claim 18, wherein said control unit is further operable to fix said steering angle of said pod propulsion unit to zero degrees when speed of said ship hull measured by said speed log exceeds a predetermined value.

20. A method of operating a ship comprising:

a ship hull, a main propeller positioned at the stern of said ship hull, a drive unit inside said hull to drive said main propeller, a rudder positioned at the stern of said ship hull and aft of said main propeller, at least one pod propulsion unit incorporating a steering strut having an airfoil section to provide a steering function, a speed log to measure speed of said ship, and a control unit operable to control a steering angle of said pod propulsion unit based on a signal from said speed log, said method comprising:

changing the course direction of said ship by changing an angle of only said rudder when ship speed measured by said speed log exceeds a predetermined value; and changing at least one of the course direction and the traveling direction of said ship by using at least said at least one pod propulsion unit having said steering strut when ship speed measured by said speed log is less than the predetermined value.

21. The method of claim 20, wherein said changing at least one of the course direction and the traveling direction of said ship by using at least said at least one pod propulsion unit having said steering strut when ship speed measured by said speed log is less than the predetermined value comprises using both said at least one pod propulsion unit having said steering strut and said rudder.

22. The method of claim 20, wherein a steering angle of said at least one pod propulsion unit is controlled based on a signal from said speed log.

23. The method of claim 22, and further comprising fixing said steering angle of said at least one pod propulsion unit at 0 degrees with respect to a centerline of said ship hull with said control unit when ship speed measured by said speed log exceeds the predetermined value.

* * * * *